United States Patent [19]

Sherwood et al.

[11] Patent Number: 4,514,946

[45] Date of Patent: May 7, 1985

[54] ARCHITRAVE

[75] Inventors: Edward F. Sherwood, Gettysburg; Karl B. Orndorff, Bonneauville, both of Pa.; Charles M. Dillon, Emmitsburg, Md.

[73] Assignee: Westinghouse Electric Corp., Pittsburgh, Pa.

[21] Appl. No.: 488,307

[22] Filed: Apr. 25, 1983

[51] Int. Cl.[3] ..... E06B 1/04

[52] U.S. Cl. ..... 52/211; 52/656; 52/741

[58] Field of Search ..... 52/211, 213, 215, 288, 52/475, 656, 716, 717, 30, 241, 242, 204, 741

[56] References Cited

U.S. PATENT DOCUMENTS 4,024,691 5/1977 Hansen et al. ..... 52/656

4,219,979 9/1980 Wiles et al. ..... 52/211 X

*Primary Examiner*—J. Karl Bell

*Attorney, Agent, or Firm*—D. R. Lackey

[57] ABSTRACT

A method of constructing a mitered, unwelded architrave. Two right angle frames or brackets are constructed, each having first and second legs disposed 90° relative to one another. First and second post sections and a head section are formed with elongated recesses, and appropriate ends mitered. The post and head sections are telescoped on to the two brackets and secured thereto, such that the frames support the architrave at each right angle corner, maintaining tight, butted, aligned miter joints without welding.

1 Claim, 8 Drawing Figures

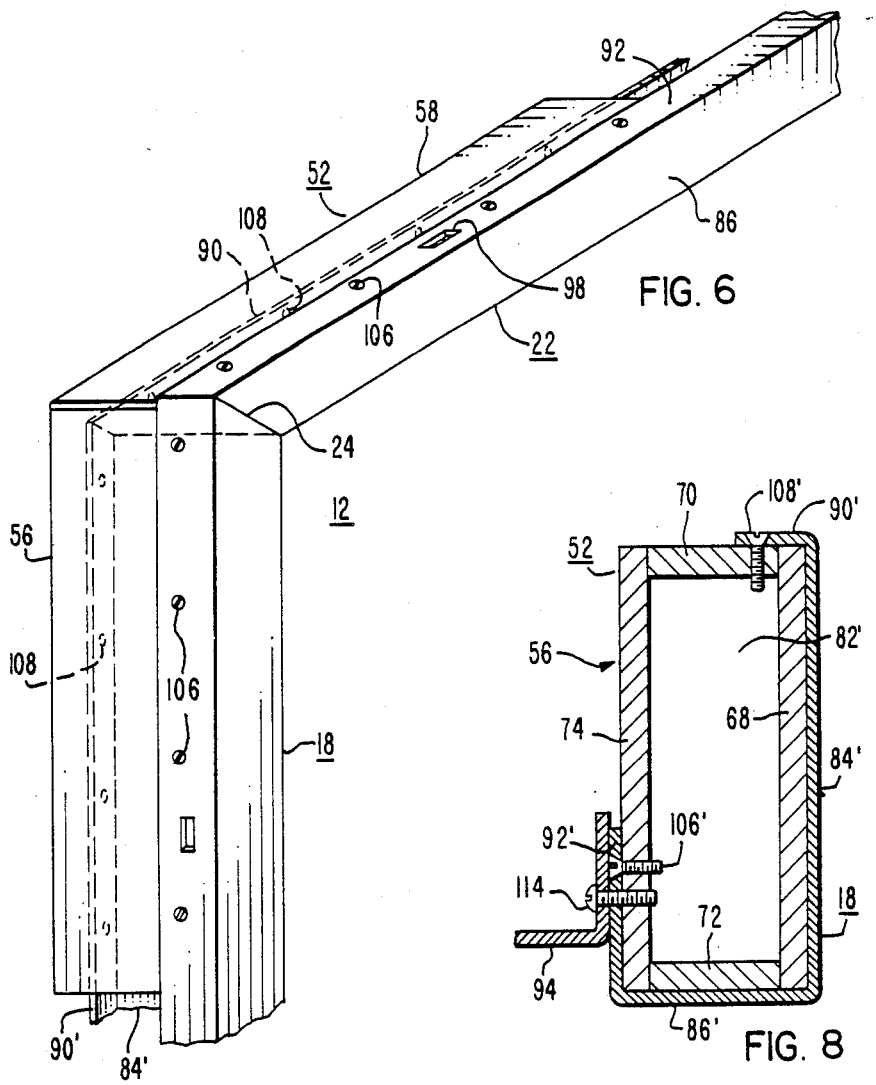
FIG. 6
FIG. 8
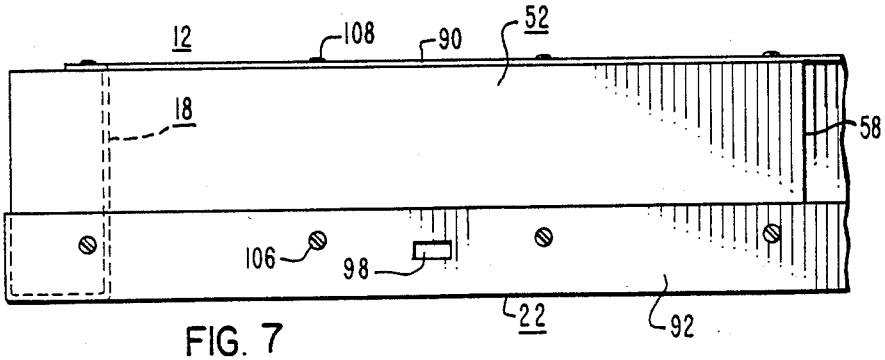
FIG. 7

ARCHITRAVE

BACKGROUND OF THE INVENTION

1. Field of the Invention

The invention relates in general to architraves, and more specifically to new and improved methods of constructing metallic achitraves.

2. Description of the Prior Art

The architrave or molding about the door of an elevator cab is required to compliment the cab decor. If the decor only requires a painted architrave, the side post and head sections may simply be mitered, welded, and painted. A problem arises when the cab utilizes metallic mirror finishes, such as stainless steel, bronze, or any #8 mirror sheet metal. Welding destroys such a finish.

SUMMARY OF THE INVENTION

Briefly, the present invention is a new and improved method of constructing metallic architraves. The method eliminates welding of the post and head sections, while providing tight, mitered joints which maintain initial tightness and alignment, as well as maintaining such tightness and alignment, notwithstanding the environment of an elevator cab, which includes intermittent movement and vibration. Rugged, 90° frames or brackets are constructed for the architrave corners, and the post and head sections of the architrave are formed into a configuration having an elongated recess sized to snugly receive a leg of a frame or bracket. The frames back the miter joints, and they provide anchor support for attaching flanges formed integrally with the post and head sections.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 6 is a perspective view of the upper lefthand corner of the architrave shown in FIG. 5;

FIG. 7 is a plan view of the upper lefthand corner of the architrave shown in FIG. 5, taken between and in the direction of arrows VII—VII; and FIG. 8 is a cross sectional view of the left-hand post shown in FIG. 5, taken between and in the direction of arrows VIII—VIII.

DESCRIPTION OF THE PREFERRED EMBODIMENTS

Figure 1:
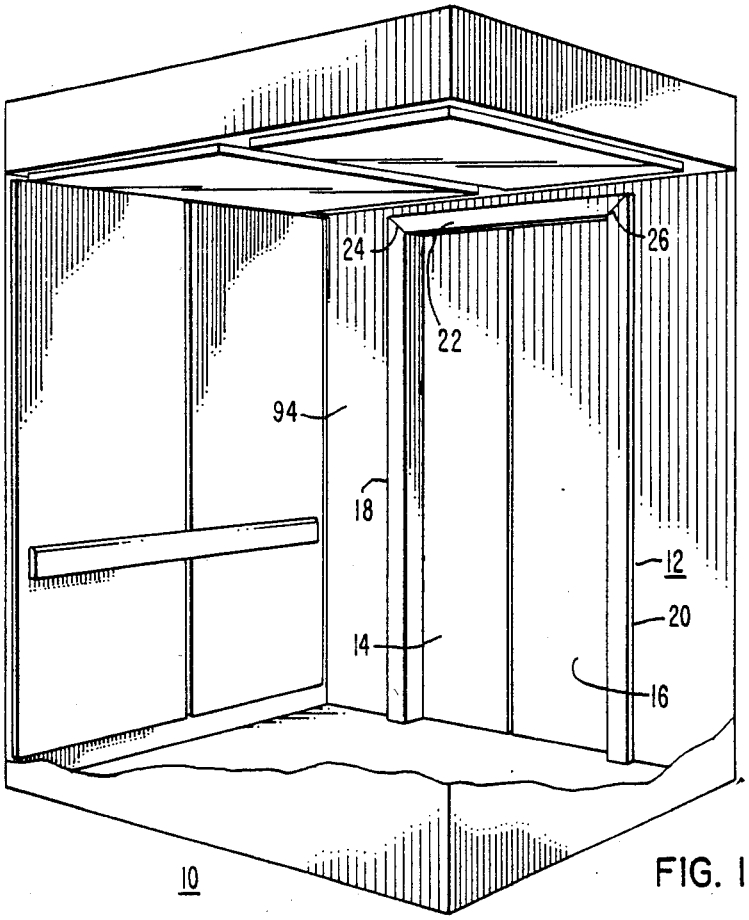
FIG. 1 is a perspective view of an elevator cab having an architrave which may be constructed according to the teachings of the invention.

Referring now to the drawings, and to FIG. 1 in particular, there is shown an elevator cab 10 having an architrave 12 which may be constructed according to the teachings of the invention. Architrave 12 surrounds the car doors, which are illustrated as being single speed, center opening (SSCO), having two panels 14 and 16, but any door arrangement may be used. Architrave 12 includes first and second upstanding, elongated metallic post sections 18 and 20, respectively, and an elongated metallic head section 22. The ends of the head section 22 join the upper ends of the first and second post sections 18 and 20 with weldless, mitered joints 24 and 26.

Figure 2:
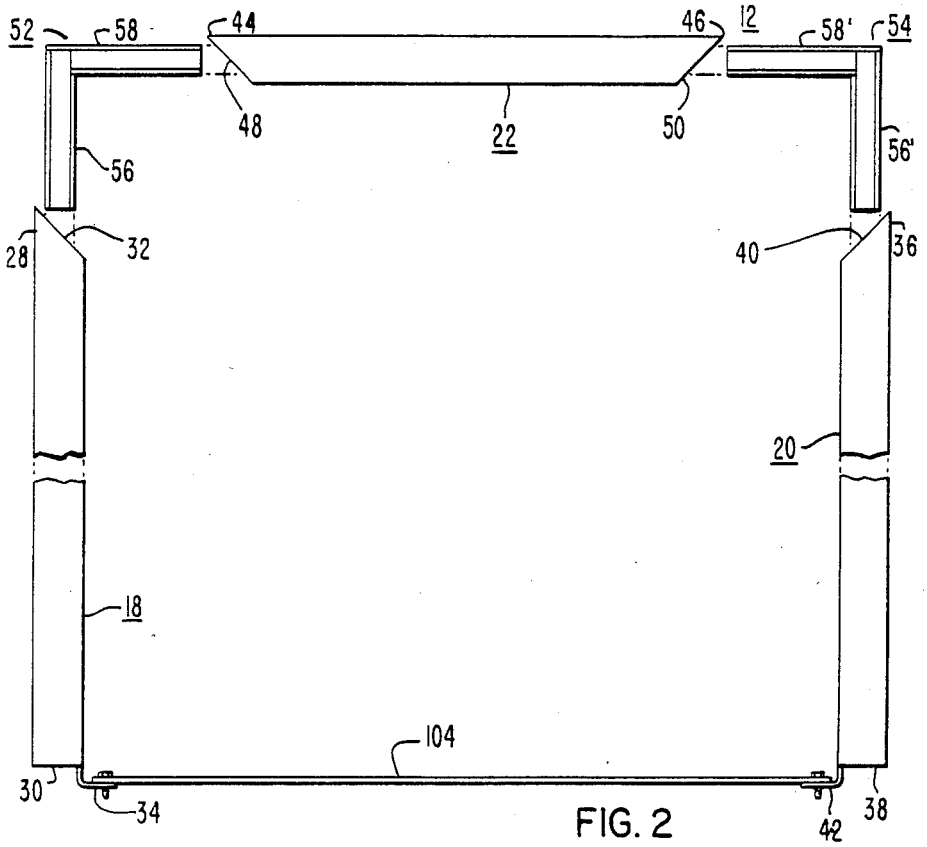
FIG. 2 is an exploded, elevational view of the architrave shown in FIG. 1, illustrating elements of the architrave which are constructed according to the teachings of the invention.

FIG. 2 is an exploded, elevational view of architrave 12. The first post section 18 has upper and lower ends 28 and 30, respectively, with the upper end 28 being mitered at 32, and with the lower end 30 including a mounting tab 34 for receiving a bolt, or other suitable fastener. In like manner, the second post section 20 has upper and lower ends 36 and 38, respectively, with the upper end 36 being mitered at 40, and with the lower end 38 including a mounting tab 42 for receiving a fastener. The head section 22 includes first and second ends 44 and 46, respectively, which are respectively mitered at 48 and 50.

First and second 90° or right angle metallic frames or brackets 52 and 54 are provided to back up and provide support for the mitered joints 24 and 26, promoting and maintaining tight, aligned joints without the necessity of welding. Thus, the post and head sections may be constructed of metals having mirror finishes, which otherwise could not be used when welding is used to join the head and post sections.

Figure 3:
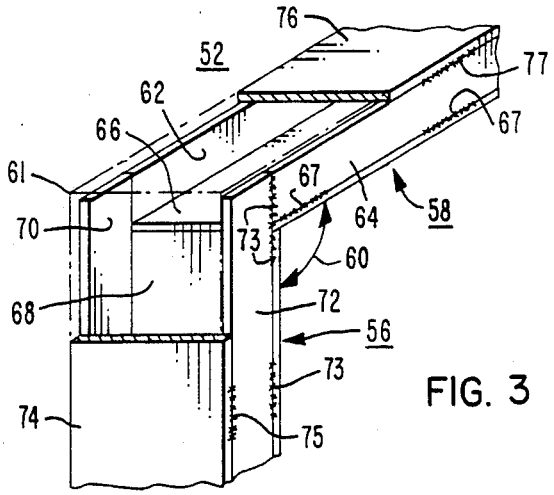
FIG. 3 is a perspective view of a 90° or right angle frame or bracket constructed according to the teachings of the invention.

FIG. 3 is a perspective view of right angle bracket 52, illustrating a preferred method of construction which utilizes eight metallic plate members, which may be constructed of 0.188 inch thick steel, for example. Bracket 52 includes first and second leg portions 56 and 58, respectively, which intersect to define a right or 90° angle, indicated at 60. Leg portions 56 and 58 may be of equal length, measured from the outer corner 61, such as a length of about 10 inches.

Leg portion 58 includes first and second like dimensioned side portions 62 and 64 which are welded to one side of a bight portion 66, adjacent to the lateral edges of bight portion 66, such as indicated generally at 67. Portions 62, 64 and 67 have the same length dimensions, such as about 8.84 inches, when the overall length of each leg is 10 inches. Leg portion 56 includes bight portion 68 which has one longitudinal end butting against the major side of bight 66, adjacent to a longitudinal end of bight 6, and first and second like dimensioned side portions 70 and 72. Leg portions 70 and 72 have a length which extends from one end of bight 68 to the upper lateral edges of leg portions 62 and 64, and they are welded to bight 68, adjacent to its lateral edges, and also to the longitudinal ends of side portions 62 and 64, such as indicated generally at 73. In the ten inch length example, bight 68 would have a length of about 8.65 inches, and side portions 70 and 72 would have a length of about 9.81 inches. Leg portion 56 is completed by welding a cover portion 74 to the lateral or side edges of portions 70 and 72, as indicated generally at 75. Portion 74 may have the same length as side portions 70 and 72. Leg portion 58 is completed by a cover portion 76, which is selected to have a length which extends from corner 61 to the aligned ends of portions 62, 64 and 66, and it would thus have a length of 10 inches, in the example. Portion 76 is welded to side portions 62 and 64, and also to side portions 70 and 72, as indicated generally at 77. The width dimensions of the plates are selected according to the desired jamb depth and reveal dimensions of the architrave. All welds should be ground flush with the adjacent flat surfaces, and the angle 60 should be accurately held, with no radius allowed. While holes may be drilled and tapped in the legs prior to assembly with the post and head sections, the holes for receiving fasteners are preferably drilled through the supporting brackets after assembly with the architrave sections. Self tapping screws, for example, may be used to hold the architrave sections in assembled relation with the right angle brackets.

Figure 4:
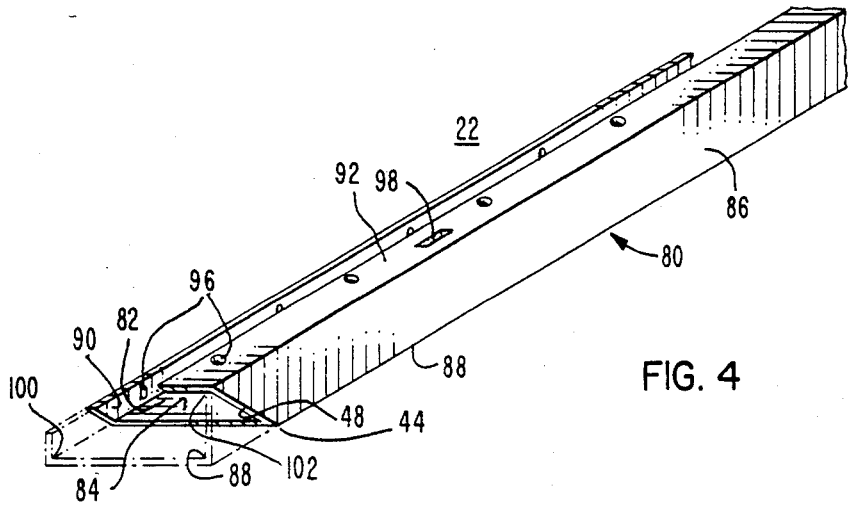
FIG. 4 is a perspective view of a head or post section constructed according to the teachings of the invention.

FIG. 4 is a perspective view of an architrave section. As illustrated, it could be the lefthand end 44 of head section 22, or the upper end 36 of the righthand post section 20. For purposes of example, it will be assumed to be the lefthand end of head section 22. Post and head sections all have the same cross sectional configuration, and thus the description of the construction of head section 22 also applies to the post sections. Like reference numerals with a prime mark are utilized to refer to portions of the posts which are the same as portions of the head section.

More specifically, head section 22 is formed from a flat sheet of metal 80 having a predetermined thickness dimension, such as 0.075 inch. Since the architrave 12 will be formed without welding, the sheet metal 80 may have a mirror finish, or any other type of finish. Sheet 80 is formed to define an elongated opening or recess 82. In general, the cross sectional configuration is L-shaped, having first and second major flat leg portions 84 and 86, respectively, integrally joined with a right angle bend 88. The first major leg portion 84 has a width dimension selected to provide the desired depth of the jamb and the second major leg portion 86 has a width dimension selected to provide the width of the reveal. The major leg portions 84 and 86 are additionally bent parallel with their longitudinally extending edges to provide flanges 90 and 92, which are utilized to secure the section to the brackets 52 and 54, and also to the adjoining wall of the elevator cab 10. Suitable openings 96 and slots 98 may be formed while the metallic sheet is flat, with the openings 96 being pilot poles for guiding a drill for drilling holes in the underlying bracket, and the slots 98 may be utilized for attaching the architrave 12 to the surrounding wall 94.

As illustated in the phantom portions of FIG. 4, the flanges 90 and 92 join major leg portions 84 and 86 with right angle bends 100 and 102, respectively, with flange 90 being parallel with leg portions 86, and extending outwardly from leg portions 84 in the same direction as leg portion 86. Flange 92 is parallel with leg portion 84, and it extends outwardly from leg portion 86 in the same direction as leg portion 84. Thus, the recess 82 has a generally rectangular shaped cross sectional configuration, and it is this configuration which the cross sectional dimensions the legs of brackets 52 and 54 are designed to closely follow. After the sections are formed to the desired configuration, the 45° miter 48 is accurately milled on end 44, and the 45° miter 50 is milled on end 46.

Figure 5:
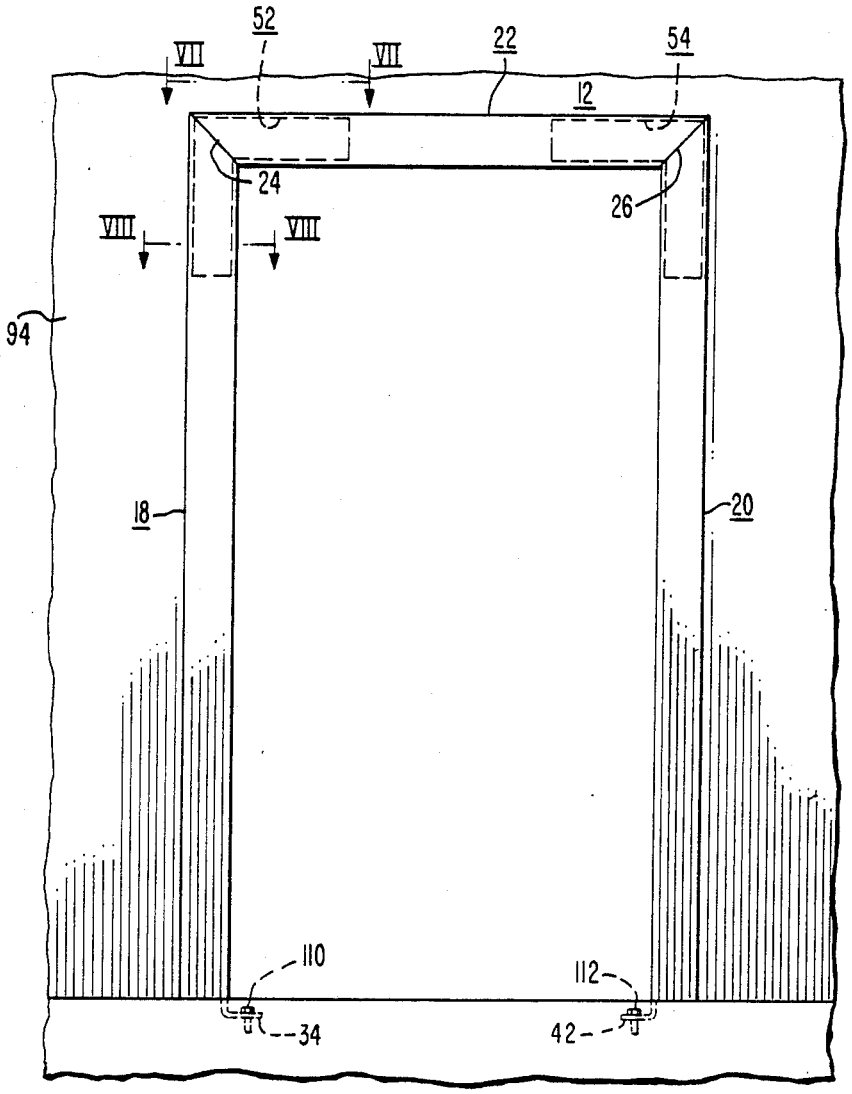
FIG. 5 is an elevational view of an architrave after assembly according to the teachings of the invention.

FIG. 5 is an elevational view of architrave 12, and it, as well in FIG. 2, will be referred to while describing the prefered assembly method. Leg portion 56 of bracket 52 is inserted into the snugly fitting longitudinal recess of the first end 28 of the first post section 18, and the corresponding leg portion 56′ of bracket 54 is inserted into the snugly fitting longitudinal recess of the first end 36 of the second post section 20. End 48 of head section 22 is then telescoped over leg portion 58 of bracket member 52, and its other end 46 is telescoped over end 58′ of bracket 54, with these fits also being snug, sliding fits. The architrave sections are accurately squared and a temporary support or brace 104 is fixed to the tabs 34 and 42. With the miters 32 and 48 held tightly together to form joint 24, and with miters 50 and 40 held tightly together to form joint 26, holes are drilled into the brackets 52 and 54, using the pilot holes 96. Self tapping screws may then be used to secure the flanges 90 and 92 to the backing bracket, or the holes may be tapped, as desired. The screws in flange 92 are shown at 106, and the screws in flange 90 are shown at 108, in FIG. 6.

FIG. 6 is a fragmentary, perspective view of the upper lefthand corner of architrave 12, after the elements of the architrave have been assembled with and fasetened to the bracket 52.

FIG. 7 is a plan view of the upper lefthand corner of architrave 12, taken between and in the direction of arrows VII—VII in FIG. 5. FIG. 7 clearly illustrates how the flanges 90 and 92 of the head section 22 are securely attached to leg portion 58 of bracket 52.

FIG. 8 is a cross sectional view of the first post section 18, taken between and in the direction of arrows VIII—VIII in FIG. 5. This view illustrates the snug sliding fit of the bracket leg 56 in the longitudinal recess 82′ defined by the full or complete side portions 84′ and 86′, and the partial side portions or flanges 90′ and 92′. This view also clearly shows how leg portion 84′ defines the jamb depth, and how leg portion 86′ defines the reveal. A portion of flange 92′ defines the wall return, with fastener 106′ being concealed behind the wall 94.

When the assembled architrave 12 is installed in the elevator cab 10, the temporary brace 104 is removed and the tabs 34 and 42 are fastened to the subfloor with bolts 110 and 112, respectively, or any other suitable fastener, as shown in FIG. 5. The post and head sections 18, 20 and 22 are fastened to the adjacent wall 94 via suitable screws which extend through slots 98, such as screw 114 shown joining wall 94 to the first side post 18 in FIG. 8.

In summary, there has been shown a new and improved method of constructing a weldless, mitered architrave for an elevator cab, which enables materials to be used which cannot be used with welded constructions. The disclosed method provides a rugged support for each upper corner of the architrave, which maintains tight, aligned mitered joints between the upstanding posts and interconnecting head section, even when subjected to intermittent movement and vibration, associated with an elevator cab.

We claim as our invention:

1. A method of constructing a mitered architrave for insertion into an opening in a wall of an elevator car, comprising the steps of:

forming first and second right angle frames each having first and second leg portions, forming first and second post sections each having first and second ends, mitering the first end of each of said first and second post sections, forming a head section having first and second ends, mitering each end of said head section, said steps of forming the post and head sections including the steps of forming a metallic sheet to provide an L-shaped right angle configuration having first and second major leg portions, with the width dimensions of said first and second major leg portions being selected to provide the desired jamb depth and reveal width, respectively, of the architrave, said steps of forming the post and head sections further including the steps of bending each of the first and second major leg portions to provide first and second right angle anchoring flanges which function to secure the post and head sections to both the wall of an elevator cab, and to the right angle frames, with the first right angle flange extending from the first major leg portion in the same direction as the second major leg portion, and with the second right angle flange extending from the second major leg portion in the same direction as the first major leg portion, said steps of forming the post and head sections creating cross sectional configurations for the associated section which define an only partially enclosed elongated recess configured and dimensioned to snugly accept a leg portion of a right angle frame, inserting the first leg portions of the first and second right angle frames into the partially enclosed recesses at the mitered first ends of the first and second post sections, inserting the second leg portion of the first right angle frame into the partially enclosed recess at the first mitered end of the head section, to tightly butt the adjoining mitered ends of the head section and first post section, inserting the second leg portion of the second right angle frame into the partially enclosed recess at the second mitered end of the head section, to tightly butt the adjoining mitered ends of the head section and second post section, securing the first and second right angle anchoring flanges of the first and second post sections to the first leg portions of the first and second right angle frames, respectively, and securing the first and second right angle anchoring flanges of the head section to the second leg portions of the first and second right angled frames, said first and second right angle anchoring flanges being adapted to secure the architrave within an opening of an elevator cab, with a portion of the second right angle anchoring flange functioning as a wall return from the reveal defined by the second major leg portion, said securing steps including the steps of applying fastener means to predetermined locations of the first and second right angle anchoring flanges which are concealed when the architrave is installed in an opening of a wall of an elevator car.

* * * * *